United States Patent [19]

Feierabent

[11] 3,986,272

[45] Oct. 19, 1976

[54] HAIR DRYER

[75] Inventor: Georg Feierabent, Olten, Switzerland

[73] Assignee: Rotel AG, Aarburg, Switzerland

[22] Filed: Feb. 28, 1975

[21] Appl. No.: 554,036

[30] Foreign Application Priority Data

Mar. 1, 1974 Switzerland ..... 2926/74

[52] U.S. Cl. ..... 34/97; 34/243 R; 219/366; 219/370; 403/160; 34/99; 34/239

[51] Int. Cl.[2] ..... A45D 20/24

[58] Field of Search ..... 34/96–101, 34/3, 239, 243 R; 219/366–372; 417/411; 403/160; 16/110 R, 111 R, 113 R, 114 R

[56] References Cited

UNITED STATES PATENTS

| | | | |
|---|---|---|---|
| 2,466,915 | 4/1949 | Shields | 34/99 |
| 2,542,038 | 2/1951 | Lewis | 403/160 |
| 2,630,114 | 3/1953 | Hart | 403/160 |
| 2,742,936 | 4/1956 | Cooley | 403/160 |
| 3,846,047 | 11/1974 | Wada | 34/97 |

FOREIGN PATENTS OR APPLICATIONS

| | | | |
|---|---|---|---|
| 1,102,164 | 10/1955 | France | 34/243 R |
| 1,091,797 | 4/1955 | France | 34/243 R |
| 943,431 | 4/1956 | Germany | 34/243 R |
| 421,405 | 3/1967 | Switzerland | 34/243 R |

*Primary Examiner*—Kenneth W. Sprague
*Assistant Examiner*—James C. Yeung
*Attorney, Agent, or Firm*—Kenneth S. Goldfarb

[57] ABSTRACT

Hair dryer comprising a motor, an air blowing nozzle and a hand grip.

The hand grip of the hair dryer is pivotably attached to the motor body so that it can be brought in two different positions. A carrier loop is detachably affixed on the blowing nozzle.

In one position of the handgrip, the hair dryer is convenient for use, in the other position it occupies little space when packed or when the loop is placed around the user's neck.

5 Claims, 8 Drawing Figures

Fig. 1
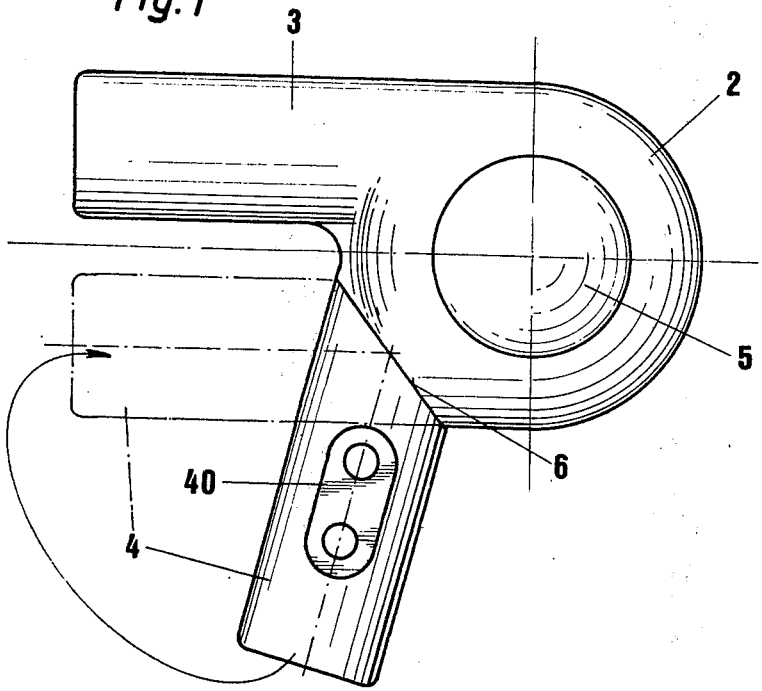
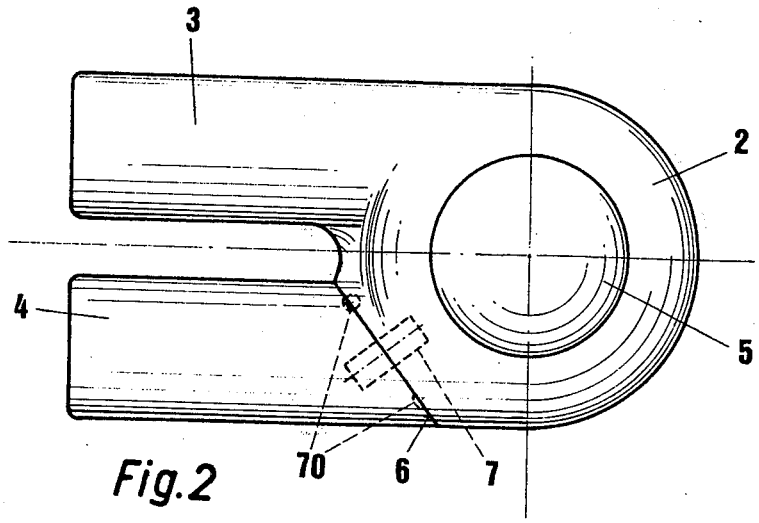
Fig. 2

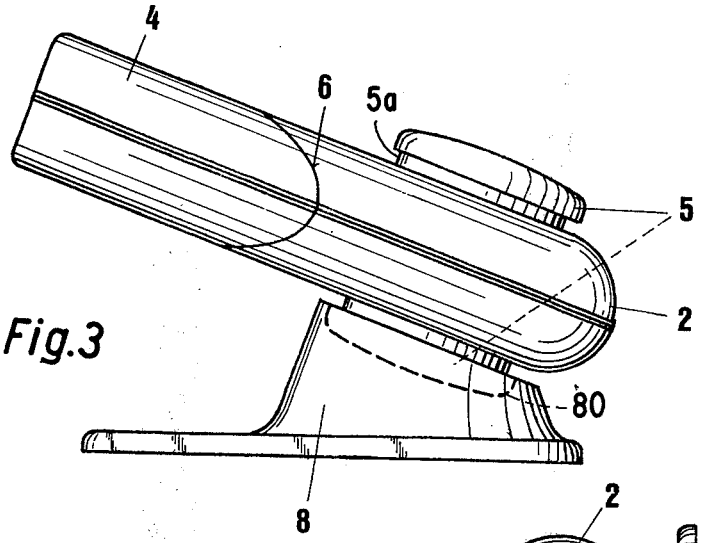
Fig.3
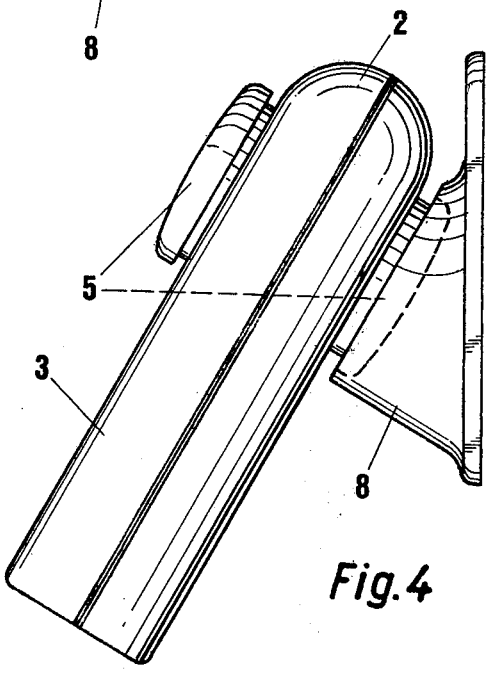
Fig.4
Fig.5
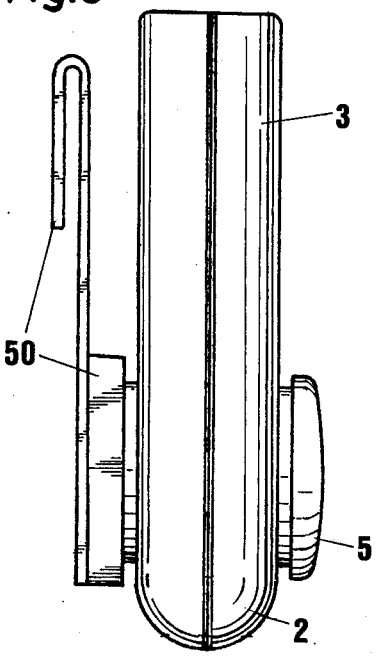

HAIR DRYER

The invention relates to a hair dryer comprising a motor, an air blowing nozzle and a hand grip.

In hair dryers of this well known type the axis of the grip is nearly perpendicular to the axis of the nozzle and to that of the motor. The hair dryer is therefore a somewhat bulky appliance which, though practical in application, occupies much space when not in use.

There are hair dryers which are of elongated cylindrical shape. These are more compact but in use they are awkward because the axis of the grip coincides with the axis of the blowing nozzle.

It is therefore the object of the invention to provide a hair dryer which is convenient to use, serviceable in many ways and will yet occupy little space when packed or stored.

The proposed hair dryer of the above specified kind is characterised by a hand grip which is pivotably attached to the motor body and adapted to be swivel deflected into a position for holding the dryer and into a position of rest.

An embodiment of the invention is shown in the drawing in which

FIG. 1 is a top view of a hair dryer in working position,

FIG. 2 is the same hair dryer in position of rest,

FIG. 3 is a side view of the hair dryer mounted on a stand,

FIG. 4 is a similar view of the hair dryer hanging on a wall,

FIG. 5 is the hair dryer suspended by a hook,

Figure 6:
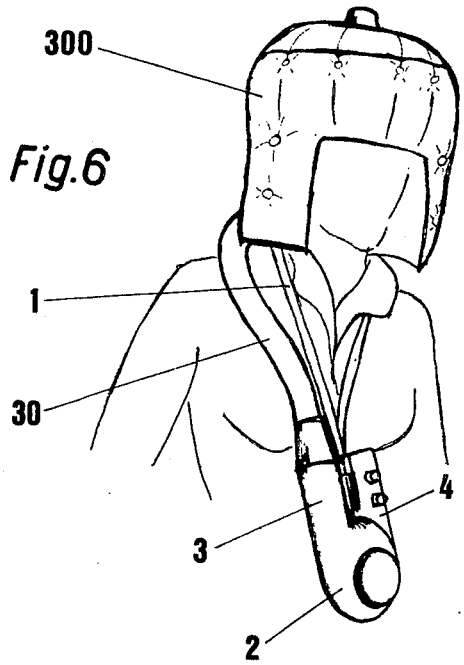
FIG. 6 is the hair dryer hanging from the neck of a user for blowing air into a drying hood placed over the user's head.

The hair dryer consists of a motor unit 2, an air blowing nozzle 3, a hand grip 4 and a button-shaped configuration 5 with a convex head.

In order to form a joint 6 between the hand grip 4 and the motor unit 2 these two components have abutting surfaces pivoting about a central common pin 7. These surfaces include an angle of about 45° with the longitudinal axis of the hand grip. FIG. 1 shows the bar-shaped grip 4 in its two end positions which are attained by 180° rotation of the bar grip 4 about the pivot 7. The grip is arrested in either position by a ball 70 engaging one of two shallow sockets.

In the illustrated example the blowing nozzle 3 as well as the elongated grip 4 have roughly the same external shapes, or they are mirror symmetrically shaped. When the grip is in position of rest, as shown in FIGS. 2 to 4, the nozzle 3 together with the grip 4 again form a bar-shaped grip. 40 is the switch for starting the motor and for controlling the temperature.

The swivelling grip 4 reduces the bulk of the hair dryer when not in use to a minimum without inpairing its practical utility.

With reference to FIG. 3 the hair dryer rests on a stand 8, one of the button shaped configurations 5 having been inserted into a recess 80 in the stand. In this way the hair dryer can be used as a fixed blower, the direction of the air jet remaining unchanged. The centre of gravity is very low, which imparts stability to the hair dryer on its stand. The stand itself may also be hung on a wall as illustrated in FIG. 4.

The button-shaped configuration 5 preferably has a neck of smaller diameter than that of the button 5 so that three barbs (not shown) around the periphery of the recess 80 in the stand can engage the neck and thus hold the hair dryer in position.

For domestic use so-called floating drying hoods are already known. These can be connected to a hair dryer by a flexible hose. The hair dryer is placed on a table or mounted on a table top support. However, it is thought to be a drawback that it is impossible for a person wearing the hood to walk about. Hair drying hoods have in fact been proposed in which the motor sits on top of the hood. However, such hoods are naturally heavy. Moreover, the noise made by the motor and its vibrations are stated to be unpleasant.

Two methods of carrying the dryer which do not share the stated drawbacks will be hereunder described.

In the hair dryer according to FIG. 5 one of the button-shaped configurations 5 has been replaced by a hanger 50. If a hair drying hood is connected to the blowing nozzle 3 the hair dryer can be suspended from a belt or the like and thus carried by the user.

Figure 7:
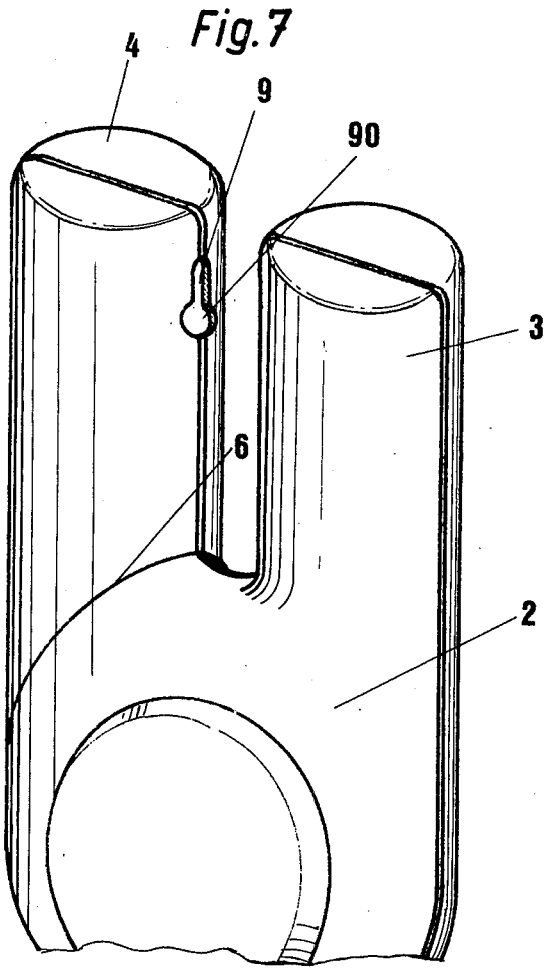
FIG. 7 is the hair dryer on a larger scale and FIG. 8 is the fastener of a carrier loop, likewise on a larger scale.
Figure 8:
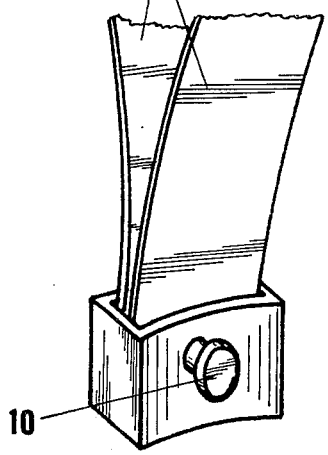

FIG. 7 is the same hair dryer in which the blowing nozzle 3 is substantially parallel to the grip 4. The latter contains a keyhole slot 9, 90 parallel to the axis of the grip and facing the side of the nozzle.

An accessory of the hair dryer is a carrier loop 1, the ends of the loop being secured in a fastener formed with a button 10 which can be inserted into the keyhole 9, 90 to suspend the hair dryer from the loop. As illustrated in FIG. 6, the carrier loop 1 can be placed around a person's neck and the hair dryer carried with the nozzle 3 pointing upwards. The end of the hot air hose 30 of a floating hood 300 can be attached to the nozzle.

Instead of using a keyhole and a button as the fastening means other arrangements can naturally be used. However, they should be simple, safe and so contrived that the hair dryer will always hang in the desired position when worn.

The embodiments of the invention in which an exclusive property or privilege is claimed are defined as follows:

1. A hair dryer comprising a motor, a stationary air blowing nozzle and a rotatable hand grip, pin means securing mating surfaces of said motor and said hand grip in abutting engagement, the plane of said abutting surfaces being at an angle of about 45° to the longitudinal axis of said air blowing nozzle, the longitudinal axis of said pin means being perpendicular to the plane of said abutting surfaces, said hand grip being rotatable 180° about its longitudinal axis to a first position wherein the longitudinal axis of said hand grip is substantially parallel to the longitudinal axis of said air blowing nozzle and to a second position wherein the longitudinal axis of said hand grip is angularly displaced from the longitudinal axis of said air blowing nozzle, and means for securing said hand grip in said first and second positions.

2. A hair dryer according to claim 1, characterised by the provision coaxially with the produced axis of the motor, at least on one side thereof, of a button-shaped configuration which provides means for securing the hair dryer to a stand.

3. A hair dryer according to claim 1, characterised in that a hook shaped hanger is attached to the motor body.

4. A hair dryer according to claim 1, characterised in that a carrier loop is detachably affixable to a part of the dryer, to permit the dryer to be carried suspended from the user's neck.

5. A hair dryer according to claim 4, characterised in that the grip contains a keyhole slot and the carrier loop has a fitting formed with a stud having an enlarged head.

* * * * *